US011056767B2

(12) United States Patent
Park et al.

(10) Patent No.: US 11,056,767 B2
(45) Date of Patent: Jul. 6, 2021

(54) ELECTRONIC DEVICE INCLUDING ANTENNA USING HOUSING THEREOF

(71) Applicant: Samsung Electronics Co., Ltd., Gyeonggi-do (KR)

(72) Inventors: Sung Chul Park, Seoul (KR); Kyi Hyun Jang, Seoul (KR); Bum Jin Cho, Gyeonggi-do (KR); Kyung Kyun Kang, Gyeonggi-do (KR); Ji Ho Kim, Gyeonggi-do (KR); Gyu Bok Park, Gyeonggi-do (KR); Kyung Moon Seol, Gyeonggi-do (KR); Hyun Jeong Lee, Gyeonggi-do (KR)

(73) Assignee: Samsung Electronics Co., Ltd

( * ) Notice: Subject to any disclaimer, the term of this patent is extended or adjusted under 35 U.S.C. 154(b) by 450 days.

(21) Appl. No.: 15/956,377

(22) Filed: Apr. 18, 2018

(65) Prior Publication Data

US 2018/0301792 A1 Oct. 18, 2018

(30) Foreign Application Priority Data

Apr. 18, 2017 (KR) ..... 10-2017-0049657

(51) Int. Cl.
*H01Q 1/24* (2006.01)
*H01Q 7/00* (2006.01)

(52) U.S. Cl.
CPC ..... *H01Q 1/243* (2013.01); *H01Q 7/00* (2013.01)

(58) Field of Classification Search
CPC ..... H01Q 1/24; H01Q 1/241; H01Q 1/242; H01Q 1/243; H01Q 1/44; H01Q 5/30; H01Q 5/307; H01Q 5/342; H01Q 7/00
See application file for complete search history.

(56) References Cited

U.S. PATENT DOCUMENTS 9,325,080 B2 * 4/2016 Ouyang ..... H01Q 21/30
9,516,150 B2 * 12/2016 Jeon ..... C25D 5/48
(Continued)

FOREIGN PATENT DOCUMENTS

CN 104377424 2/2015
CN 104821438 8/2015
(Continued)

OTHER PUBLICATIONS

European Search Report dated Jul. 30, 2018 issued in counterpart application No. 18168101.6-1205, 9 pages.
(Continued)

*Primary Examiner* — Dimary S Lopez Cruz
*Assistant Examiner* — Patrick R Holecek
(74) *Attorney, Agent, or Firm* — The Farrell Law Firm, P.C.

(57) ABSTRACT

An electronic device includes a first antenna configured to transmit and receive a first signal of a first frequency band, and a housing in which the first antenna is accommodated, wherein the housing includes a first conductor having a first slit that at least partially overlaps the first antenna, wherein the first conductor is formed of a metal and at least a portion of the first slit is filled with a metal oxide. Additionally, the electronic device includes a second conductor configured to transmit and receive a second signal of a second frequency band, and a second slit formed between the first conductor and the second conductor, and wherein the second slit is filled with a material that has an external appearance that is different from that of the second conductor.

13 Claims, 10 Drawing Sheets

(56) References Cited

U.S. PATENT DOCUMENTS

| | | | | |
|---|---|---|---|---|
| 10,186,753 | B2 | 1/2019 | Ason et al. | |
| 2015/0050968 | A1 | 2/2015 | Jeon et al. | |
| 2015/0222009 | A1* | 8/2015 | Asou | H01Q 7/00 343/702 |
| 2015/0241921 | A1 | 8/2015 | Gu et al. | |
| 2016/0111889 | A1* | 4/2016 | Jeong | H01F 38/14 320/108 |
| 2016/0315373 | A1* | 10/2016 | Azad | H01Q 1/48 |
| 2017/0019510 | A1 | 1/2017 | Jeon et al. | |
| 2017/0197344 | A1 | 7/2017 | Gu et al. | |
| 2017/0199546 | A1 | 7/2017 | Gu et al. | |

FOREIGN PATENT DOCUMENTS

| | | |
|---|---|---|
| CN | 105228399 | 1/2016 |
| CN | 105657101 | 6/2016 |
| CN | 205657164 | 10/2016 |
| CN | 205992590 | 3/2017 |
| WO | WO 2017/052159 | 3/2017 |

OTHER PUBLICATIONS

European Search Report dated Jul. 11, 2019 issued in counterpart application No. 18168101.6-1205, 11 pages.
Chinese Office Action dated Sep. 17, 2020 issued in counterpart application No. 201810347407.X, 24 pages.

* cited by examiner

500

500a

500b

610a

610b

620a

620b

630a

630b

ELECTRONIC DEVICE INCLUDING ANTENNA USING HOUSING THEREOF

CROSS-REFERENCE TO RELATED APPLICATION(S)

This application is based on and claims priority under 35 U.S.C. § 119 to Korean Patent Application No. 10-2017-0049657, filed on Apr. 18, 2017, in the Korean Intellectual Property Office, the disclosure of which is incorporated by reference herein its entirety.

BACKGROUND

1. Field

The present disclosure relates generally to an antenna technology that utilizes a housing of an electronic device.

2. Description of Related Art

An electronic device, such as a smartphone or a tablet personal computer (PC), may communicate with a network using an antenna that includes a radiator with a conductive material.

If a component of a metallic material is present around the radiator of the antenna, the radiation performance of the antenna may deteriorate due to a scattering effect by a metal, an effect of being restricted by electromagnetic fields, or an effect caused by mismatching of a metal.

The housings of recent electronic devices have been replaced by metallic materials to increase the strengths of the electronic devices and improve the designs of the electronic devices.

If metallic housings are used, the radiation performances of the antennas included in the electronic devices deteriorate. In order to solve the problem, a partial area of the metallic housing may be manufactured of a nonmetallic material.

A slit filled with a dielectric material may be added to a portion of the metallic housing to improve the radiation performance of the antenna. If the slit is added to the housing, a signal may be transmitted through the slit. However, an aesthetic aspect of the electronic device may be spoiled as the external appearances of the dielectric material and the metal housing are different.

SUMMARY

Embodiments of the present disclosure are described below to address at least the above-mentioned problems and/or disadvantages and to provide at least the advantages described below.

In accordance with an aspect of the present disclosure, an electronic device is provided in which a metal oxide area is formed in a metal housing when an antenna using the metal housing is formed.

In accordance with another aspect of the present disclosure, the radiation performance of the antenna may be improved by forming a portion of the metal housing with a metal oxide.

In accordance with another aspect of the present disclosure, the design of the device may be improved by using a metal oxide having the same external appearance as the metal housing.

According to an embodiment, an electronic device is provided including a first antenna configured to transmit and receive a first signal of a first frequency band, and a housing in which the first antenna is accommodated, wherein the housing includes a first conductor having a first slit that at least partially overlaps the first antenna, wherein the first conductor is formed of a metal and at least a portion of the first slit is filled with a metal oxide, a second conductor configured to transmit and receive a second signal of a second frequency band, and a second slit formed between the first conductor and the second conductor, and wherein the second slit is filled with a material that has an external appearance that is different from that of the second conductor.

In accordance with another embodiment, an electronic device is provided including a housing that defines an external appearance of the electronic device, a coil antenna accommodated in the interior of the housing, and a wireless communication circuit configured to feed electric power to the coil antenna, wherein the housing includes a first area that at least partially overlaps an area in which the coil antenna is disposed to and that is formed of a metal oxide, a second area spaced apart from the first area and formed of a conductive material, and at least one slit disposed between the first area and the second area.

In accordance with another embodiment, an electronic device is provided including a housing that includes a first plate having a first width, a second plate that is opposite to the first plate, and a side surface that surrounds a space between the first plate and the second plate, a coil antenna accommodated in the interior of the housing, and a wireless communication circuit configured to feed electric power to the coil antenna, wherein the first plate includes a first conductive area having the first width and formed of a conductive material, a slit having the first width and formed adjacent to the first conductive area, a first area having the first width, being adjacent to the slit, and formed of a metal oxide, and a second conductive area having the first width, being adjacent to the first area, and formed of the conductive material that partially overlaps the coil antenna, and wherein the first area overlaps the coil antenna in at least a partial area, and the conductive material is disposed below the slit and the at least partial area of the first area.

BRIEF DESCRIPTION OF THE DRAWINGS

The above and other aspects, features, and advantages of certain embodiments of the present disclosure will be more apparent from the following detailed description taken in conjunction with the accompanying drawings, in which.

DETAILED DESCRIPTION

Figure 1:
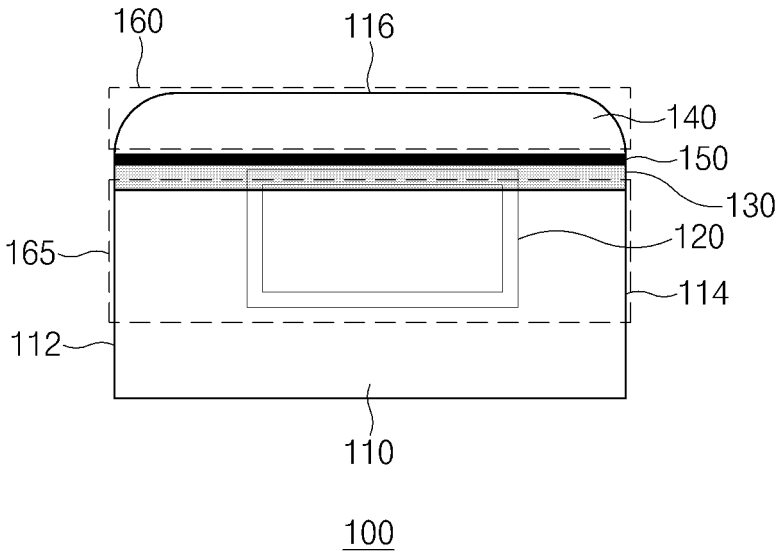
FIG. 1 is a plan view of a plate of an electronic device, according to an embodiment.

Embodiments of the present disclosure are described with reference to accompanying drawings. However, embodiments of the present disclosure are not limited to specific embodiments, and it should be understood that modifications, equivalents, and/or alternatives of the embodiments described herein can be variously made without departing from the scope and spirit of the present disclosure. Descriptions of well-known functions and/or configurations will be omitted for the sake of clarity and conciseness. With regard to descriptions of drawings, similar elements may be designated by the same reference numeral.

Terms used in this disclosure may include plural forms unless otherwise specified. Technical or scientific terms used herein may have a meaning that is generally understood by a person of ordinary skill in the art. It is further understood that terms which are defined in a dictionary and commonly used should also be interpreted as is customary in the relevant related art and not in an idealized or overly formal manner unless expressly so defined.

The expressions "have", "may have", "include", "comprise", "may include" and "may comprise" used herein indicate the existence of elements such as numeric values, functions, operations, or components but do not exclude the presence of additional features.

The expressions "A or B", "at least one of A or B", "at least one of A and B", "one or more of A or B", or "one or more of A and B", may include any and all combinations of the listed items. For example, the term "A or B", "at least one of A and B", or "at least one of A or B" may refer to (1) where at least one A is included, (2) where at least one B is included, or (3) where both of at least one A and at least one B are included.

As used herein, the terms "first" and "second" may use various elements regardless of order or importance and may distinguish an element from another without limiting the elements. For example, "a first user device" and "a second user device" may indicate different user devices although both of them are user devices. Further, without departing the scope of the present disclosure, a first element may be referred to as a second element, and similarly, a second element may be referred to as a first element.

When an element (e.g., a first element) is referred to as being "operatively coupled with", "operatively coupled to", "communicatively coupled with", "communicatively coupled to", or "connected to" another element (e.g., a second element), the element may be directly coupled with or connected to the other element or an intervening element (e.g., a third element) may be present. In contrast, when an element (e.g., a first element) is referred to as being "directly coupled with", "directly coupled to" or "directly connected to" another element (e.g., a second element), it should be understood that there is no intervening element (e.g., a third element).

The expression "configured to" may be used interchangeably with "suitable for", "having the capacity to", "designed to", "adapted to", "made to", or "capable of". The expression "configured to" may not be used to refer to only something that is "specifically designed to" in hardware. Instead, the expression "a device configured to" may mean that the device is "capable of" operating together with another device or with other components. For example, a "processor configured to perform A, B, and C" or "a processor set to perform A, B, and C" may refer to a dedicated processor (e.g., an embedded processor) for performing a corresponding operation or a generic-purpose processor (e.g., a central processing unit (CPU) or an application processor (AP)) which performs corresponding operations by executing one or more software programs stored in a memory device.

An electronic device according to various embodiments of the present disclosure may include smartphones, tablet personal computers (PCs), mobile phones, video telephones, electronic book readers, desktop PCs, laptop PCs, netbook computers, workstations, servers, personal digital assistants (PDAs), portable multimedia players (PMPs), Motion Picture Experts Group (MPEG-1 or MPEG-2) audio layer 3 (MP3) players, mobile medical devices, cameras, or wearable devices. The wearable device may include at least one of an accessory type device (e.g., a watch, a ring, a bracelet, an anklet, a necklace, glasses, a contact lens, a head mounted device (HMDs), a fabric or garment-integrated type device (e.g., an electronic apparel), a body-attached type device (e.g., a skin pad or tattoo), or a bio-implantable type device (e.g., an implantable circuit).

The electronic device may include home appliances, such as televisions (TVs), digital versatile disc (DVD) players, audio players, refrigerators, air conditioners, cleaners, ovens, microwave ovens, washing machines, air cleaners, set-top boxes, home automation control panels, security control panels, TV boxes (e.g., Samsung HomeSync™, Apple TV™, or Google TV™), game consoles (e.g., Xbox™ or PlayStation™), electronic dictionaries, electronic keys, camcorders, and electronic picture frames.

An electronic device may further include at least one of various medical devices, such as a portable medical measurement device (e.g., a blood glucose monitoring device, a heartbeat measuring device, a blood pressure measuring device, and a body temperature measuring device), a magnetic resonance angiography (MRA) device, a magnetic resonance imaging (MRI) device, a computed tomography (CT) device, scanners, and ultrasonic devices, navigation devices, global navigation satellite system (GNSS), event data recorders (EDRs), flight data recorders (FDRs), vehicle infotainment devices, electronic equipment for vessels (e.g., navigation systems or gyrocompasses), avionics devices, security devices, head units for vehicles, business or home robots, automated teller machines (ATMs), points of sales (POSs) terminals, or Internet of things devices (e.g., light bulbs, various sensors, electric or gas meters, sprinkler devices, fire alarms, thermostats, street lamps, toasters, exercise equipment, hot water tanks, heaters, and boilers).

The electronic device may additionally include at least one of parts of furniture or buildings/structures, electronic boards, electronic signature receiving devices, projectors, or various measuring instruments (e.g., water meters, electricity meters, gas meters, or radio wave meters). The electronic device may be a flexible, or may be a combination of two or more of the aforementioned devices. The electronic device is not be limited to the above-described electronic devices and may include other electronic devices and new electronic devices according to the development of technologies.

FIG. 1 is a plan view of a plate of an electronic device, according to an embodiment.

Referring to FIG. 1, the electronic device 100 may be surrounded by a housing. The housing of the electronic device 100 may include a front plate, a rear plate that is opposite to the front plate, and a side surface that surrounds a space between the front plate and the rear plate. The front plate and the rear plate may include a conductive material.

FIG. 1 illustrates one plate, i.e., a first plate 110, which may be a front plate or a rear plate. The front plate may be referenced as an area of a front housing, but not including a display.

The electronic device 100 includes a coil antenna 120 in the interior of the housing, and a wireless communication circuit for feeding electric power to the coil antenna 120. The coil antenna 120 may also be referred to as a first antenna 120.

The first plate 110 includes a first area 130, a second area 140, and at least one slit 150. The first area 130 at least partially overlaps an area in which the coil antenna 120 is disposed, and may be formed of a metal oxide. The second area 140 is spaced apart from the first area 130, and may be formed of a conductive material.

The at least one slit 150 is disposed between the first area 130 and the second area 140. The at least one slit 150 may be filled with another dielectric material, a permittivity of which is different from that of the metal oxide.

The coil antenna 120 may be disposed in the interior of the housing, or may be attached to the first plate 110 to transmit and receive a signal of a specific frequency band. A signal output from the coil antenna 120 may be transmitted to the outside through at least a portion of the first area 130 formed of the metallic material.

If the coil antenna 120 is disposed in the interior of the metal housing, an eddy current is formed in a direction that is opposite to the direction of a current flowing through a coil so that the performance of the coil antenna 120 may deteriorate. If the coil antenna 120 and a portion of the first area 130 overlap each other, the path of the eddy current change. The first area 130 may be a radiation path of the output signal. Accordingly, the performance of the antenna may improve.

The first area 130 may be oxidized through anodizing. For example, the housing may be formed of aluminum, and the metal oxide formed in the first area 130 may be aluminum oxide. In this case, the first area 130 may have an external appearance that is substantially (e.g., visually) the same as or similar to the housing. In another example, the first area 130 may be a slit formed in the housing and the slit may be filled with aluminum oxide.

The coil antenna 120 may include a near field communication (NFC) antenna. The NFC antenna may be disposed in an area other than the main antenna and an area in which other antennas (e.g., global positioning system (GPS) antennas, Bluetooth (BT) antennas, and wireless fidelity (Wi-Fi) antennas) are disposed.

The coil antenna 120 may include a magnetic secure transmission (MST) coil or a wireless charging coil. An NFC coil, an MST coil, and/or a wireless charging coil may share at least a partial area of the coil antenna 120.

The slit 150 may extend from any one point of a first side 112 of a periphery of the housing to any one point of a second side 114 of the periphery of the housing, which is parallel to the first side 112. Accordingly, a second area 140 may be isolated from the remaining areas of the housing, except through the slit 150.

If electric power is fed to the second area 140, the second area 140 may become an antenna radiator that is isolated from the other areas of the housing by the slit 150. The second area 140 of an upper end of the housing may transmit and receive a signal of a frequency band that is different from that of the coil antenna 120. For example, the second area 140 may be operated as a main antenna for cellular communication.

The first area 130 may extend from any one point of the first side 112 of the housing to any one point of the second side 114 of the housing, which is parallel to the slit 150. Then, because at least a portion of the first area 130 overlaps an area in which the coil antenna 120 is disposed, radiation may penetrate through at least a portion of the first area 130.

If the overlapping area becomes larger, the performance of the coil antenna 120 may improve. Accordingly, as the size of the coil antenna 120 becomes larger, or the area in which the first area 130 and the coil antenna 120 overlap each other becomes larger, the performance of the coil antenna 120 may improve significantly.

The first area 130 may function as a radiation path of the coil antenna 120, and may function to isolate the second area 140 from the remaining areas of the areas of the housing. When the second area 140 is operated as an antenna element, the performances of the coil antenna 120 and the antenna element of the second area 140 may be improved by the first area 130.

The first area 130 of the electronic device 100 may be a slit. The electronic device 100 may include a first antenna 120 that transmits and receives a first signal of a first frequency band and a housing. The first antenna 120 may be disposed in the interior of the housing, and the housing may include a first conductor 165. A first slit 130 that at least partially overlaps the first antenna may be formed in the first conductor 165.

The first conductor 165 may be formed of a metal, and at least a portion of the first slit 130 may be filled with a metal oxide. The electronic device 100 may include a second conductor 160 that transmits and receives a second signal of a second frequency band. The electronic device 100 may include a second slit 150 formed between the first conductor 165 and the second conductor 160. The second slit 150 may be filled with a material having an appearance that is different from that of the second conductor 160. The first conductor 165 and the second conductor 160 may be formed of aluminum. The first slit 130 may be filled with aluminum oxide. The second slit 130 may be filled with an insulating material that is different from aluminum oxide.

Figure 2:
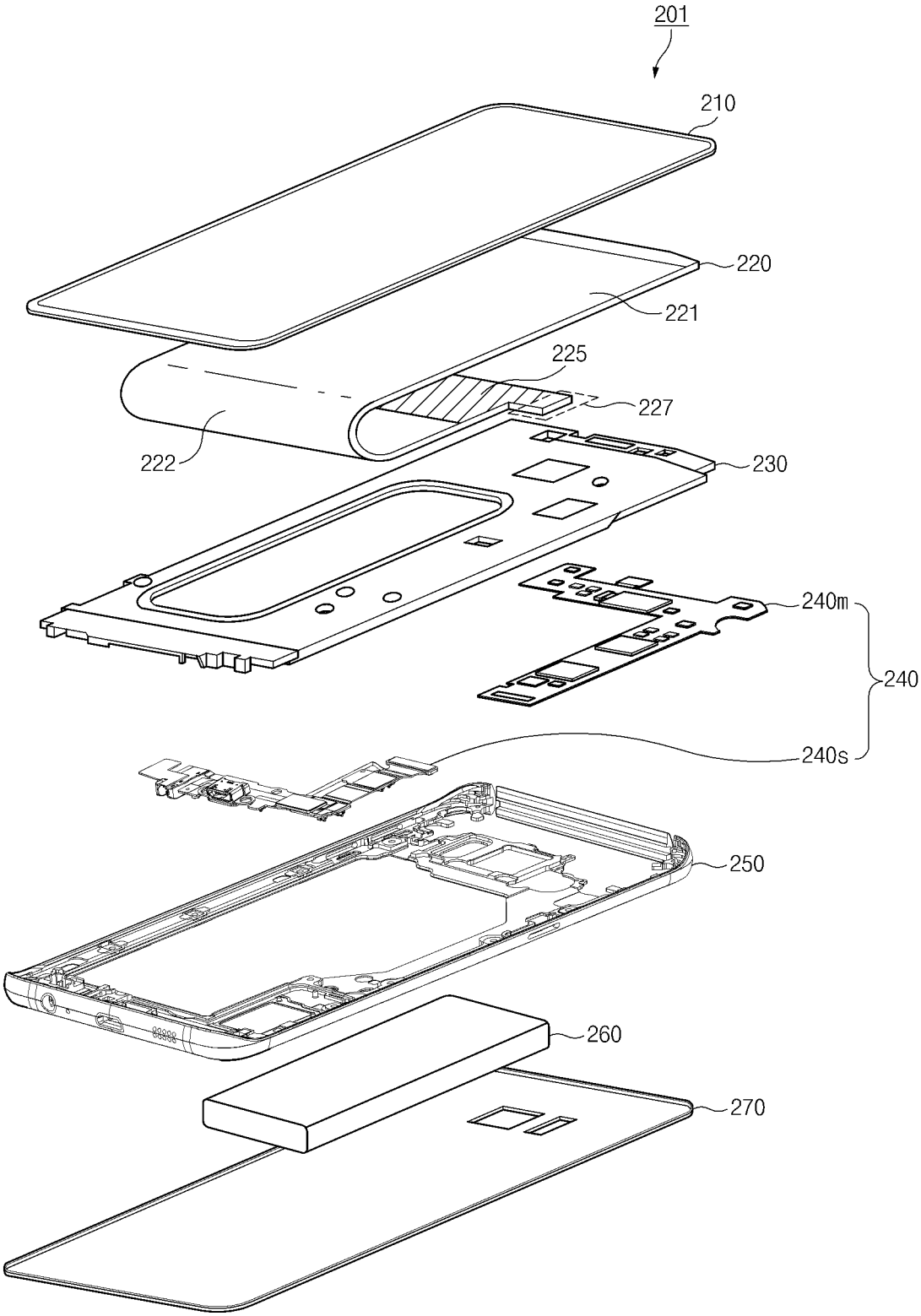
FIG. 2 illustrates an exploded perspective view of an electronic device, according to an embodiment.

FIG. 2 illustrates an exploded perspective view of an electronic device, according to an embodiment.

Referring to FIG. 2, the electronic device 201 includes a front cover 210, a display device 220, a bracket 230, a circuit board 240, a rear housing 250, a battery 260, and a back cover 270. The electronic device 201 is not limited to the configuration of FIG. 2, and may include other configurations that are not illustrated in FIG. 2. For example, the housing of the electronic device 100 of FIG. 1 may include a front cover 210, a rear housing 250, and a back cover 270.

The display device 220 may be disposed below the front cover 210 or may be coupled to the front cover 210. The display device 220 may be exposed through at least a portion of the front cover 210. The display device 220 may output content (e.g., text, images, videos, icons, widgets, or symbols) or may receive a touch input (a touch input, a gesture input, or hovering input) from the user.

The display device 220 includes a display area 221 and a connection area 222 that extends from one side (e.g., an upper side, a lower side, a left side, or a right side) of the display area 221. Pixels (e.g. organic light emitting diodes (OLEDs)) for displaying various pieces of information may be disposed in the display area 221. The connection area 222 may be electrically connected to a flexible printed circuit board (FPCB) 225 disposed on a rear surface of the display device 220 through various conductive patterns (e.g., wiring lines)

A portion of the connection area 222 may be bent toward a rear surface of the display area 221 such that a rear surface of the FPCB 225 may be spaced apart from the rear surface of the display area 221 to be opposite to the rear surface of the display area 221. The conductive patterns formed in a partial area 227 of the FPCB 225 may pass by a side surface of a bracket 230 and may be electrically connected to a circuit board 240 (e.g., a main circuit board 240*m*) through a specific connector. Pixels for displaying various pieces of information, similar to the display area 221, may be disposed in the connection area 220, depending on a design of the electronic device 201.

The bracket 230 may be formed of a magnesium alloy, and may be disposed below the display device 220 and above the circuit board 240. The bracket 230 may be coupled to the display device 220 and the circuit board 240 to physically support the display device 220 and the circuit board 240. A swelling gap that is formed in consideration of swelling of the battery 260 may be formed in the bracket 230.

The circuit board 240 may include a main circuit board 240*m* and a sub circuit board 240*s*. The main circuit board 240*m* and the sub circuit board 240*s* may be disposed below the bracket 230, and may be electrically connected to each other through a specific connector or a specific wiring line. The circuit boards 240*m* and 240*s* may be realized by a rigid printed circuit board (PCB).

Various electronic components, elements, PCBs, processors, memories, or communication circuits of the electronic device 201 may be mounted on or arranged in the circuit boards 240*m* and 240*s*. The circuit boards 240*m* and 240*s* may be referenced as a main board, a printed board assembly (PBA), or a PCB.

The rear housing 250 may be disposed below the circuit board 240 and may receive configurations of the electronic devices 201. The rear housing 250 may define an external appearance of a side surface of the electronic device 201. The rear housing 250 may also be referred to as a rear case or a rear plate. The rear housing 250 may include an area that is not exposed to the outside of the electronic device 201 and an area that is exposed to an outer side surface of the electronic device 201. The area that is not exposed to the outside of the electronic device 201 may be formed of injection-molded plastic. The area that is exposed to the outer side surface of the electronic device 201 may be formed of a metal. The exposed side area formed of a metal may be referred to as a metal bezel. At least a portion of the metal bezel may be utilized as an antenna radiator for transmitting and receiving a signal of a specific frequency.

The battery 260 may convert chemical energy into electrical energy and vice versa. The battery 260 may supply the electrical energy to the display device 220 and various modules mounted on the circuit board 240.

The back cover 270 may be coupled to a rear surface of the electronic device 201 and may be formed of tempered glass, injection-molded plastic, and/or a metal. The back cover 270 may be integrally formed with the rear housing 250 or may be detachably mounted on the rear housing 250 by the user.

The first plate 110 referenced in FIG. 1 may correspond to a front cover 210 or a back cover 270, and the first area 130 and the at least one slit 150 may be formed in the front cover 210 or the back cover 270.

Figure 3:
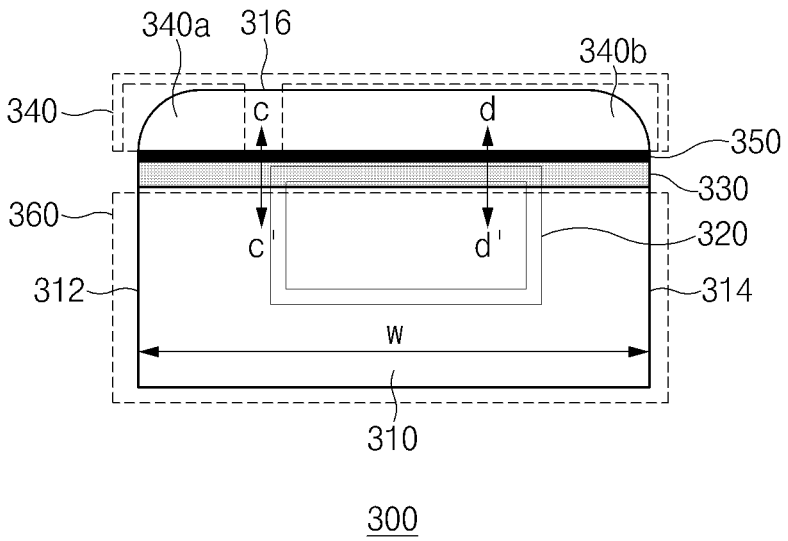
FIG. 3 is a plan view of a plate of an electronic device including a plurality of antenna elements, according to an embodiment.
Figure 3:
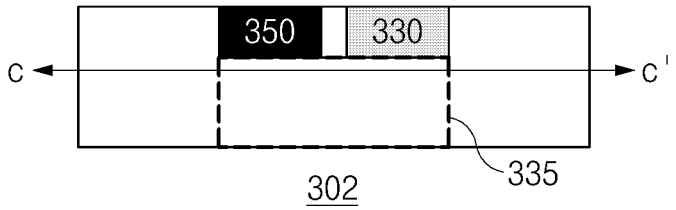
Figure 3:
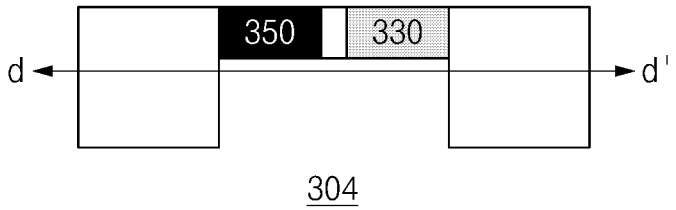

FIG. 3 is a plan view of a plate of an electronic device including a plurality of antenna elements, according to an embodiment.

Although two antenna elements are included in a housing in FIG. 3, the present disclosure is not limited thereto, and the housing may further include more than two antenna elements.

Referring to FIG. 3, the housing of the electronic device 300 includes a first plate 310 having a first width, a second plate that is opposite to the first plate 310, and a side surface that surrounds a space between the first plate 310 and the second plate. The first plate 310 may be a front plate or a rear plate.

The first plate 310 may have the first width that may be a transverse width w of the first plate 310.

The first plate 310 includes a first conductive area 340 formed of a conductive material. The first plate 310 has a first width, and a slit 350 may be formed adjacent to the first conductive area 340. The first plate 310 may have the first width, and may include a first area 330 that is adjacent to the slit 350 and formed of a metal oxide. The first plate 310 may have the first width, and may include a second conductive area 360 that is adjacent to the first area 330 and partially overlaps the coil antenna 320. The second conductive area 360 may be formed of the conductive material that forms the first plate 310.

The side surface of the housing may include a first side 312, a second side 314 that faces the first side 312, and a third side 316 that is perpendicular to the first side 312. The first area 330 and the slit 350 may be formed in parallel to the third side 316 from a first point of the first side 312 to a second point of the second side 314. Accordingly, the first plate 310, the first area 330, and the slit 350 may have substantially the same width.

The conductive material may be disposed in a below area 335 of at least a portion of the slit 350 and at least a portion of the first area 330. The first conductive area 340 and the second conductive area 360 may be electrically connected to each other by the conductive material disposed in the below area 335 of the at least portion of the slit 350 and the at least a portion of the first area 330.

For example, a conductive material included in the first plate 310 may be disposed in the below area 335 including the zone c-c'. Accordingly, the first conductive area 340 and the second conductive area 360 may be electrically connected to each other in the zone c-c' by the conductive material of the below area 335.

The first area 330 may overlap the coil antenna 320 in at least a partial area. A signal output from the coil antenna 320 may be transmitted to the outside through an area of the first area 330, but not through a portion of the first area 330 at which the conductive material is disposed. As the area in which the coil antenna 320 and the first area 330 overlap each other becomes larger, the performance of the coil antenna 320 may improve.

The first conductive area 340 and the second conductive area 360 may be isolated by an area of the first area 330, except for the portion of the first area 330 at which the conductive material is disposed. Because the first area 330 is formed of a metal oxide that is an insulating material, the first area 330 may electrically isolate the first conductive area 340 and the second conductive area 360. Accordingly, the first area 330 may not only function to isolate an area of the metal housing but also function as a radiation path of the coil antenna 320.

For example, the first conductive area 340 and the second conductive area 360 may be electrically isolated by the slit 350 including a zone d-d' and the first area 330.

The electronic device 300 may include a plurality of antenna elements. For example, the coil antenna 320 may transmit and receive a first signal of a first frequency band. The first conductive area 340 may include a second area 340*a* that transmits and receives a second signal of a second frequency band that is different from the first frequency band, and the first conductive area 340 may include a third area 340*b* that transmits and receives a third signal of a third frequency band that is different from the first frequency band and the second frequency band.

When the second area 340*a* and the third area 340*b* are main antennas for communication, the second area 340*a* may transmit and receive a signal of a high frequency band and the third area 340*b* may transmit and receive a signal of a low frequency band.

In order to operate the second area 340*a* and the third area 340*b* as antennas, a wireless communication circuit, such as the wireless communication circuit of FIG. 1, of the electronic device 300 may feed electric power to the first conductive area 340. Further, the wireless communication circuit of the electronic device 300 may also feed electric power to the second area 340*a* and the third area 340*b*.

The second frequency band may be higher than the third frequency band. The second area 340*a* and the third area 340*b* may be operated as different antenna elements by the conductive material disposed in the below area 335.

For example, when the portions are formed in a zone c-c', the length of the slit 350 functioning as the radiator of the second area 340*a* may be smaller than the length of the slit 350 functioning as the radiator of the third area 340*b*. The second area 340*a* may transmit and receive a frequency of a higher frequency band than that of the third area 340*b*.

The slit 350 may be filled with an insulating material having a first permittivity, and the first area 330 may be formed of a metal oxide having a second permittivity that is higher than the first permittivity. For example, the slit 350 may be filled with an injection-molded material, and the first area 330 may be formed of aluminum oxide.

In an experimental example, the slit 350 was filled with aluminum oxide having the same permittivity as the first area 330, and the first conductive area 340 was operated as an antenna element that uses a high frequency wave of 700 MHz to 2700 MHz. Consequently, the performance of the antenna element deteriorated because the isolation by the slit 350 decreased as the capacitance of the slit 350 increased. If the slit 350 is filled with an insulating material having a lower permittivity, the performance of the antenna may improve when the antenna of the first conductive area 340 uses a high frequency.

Figure 4:
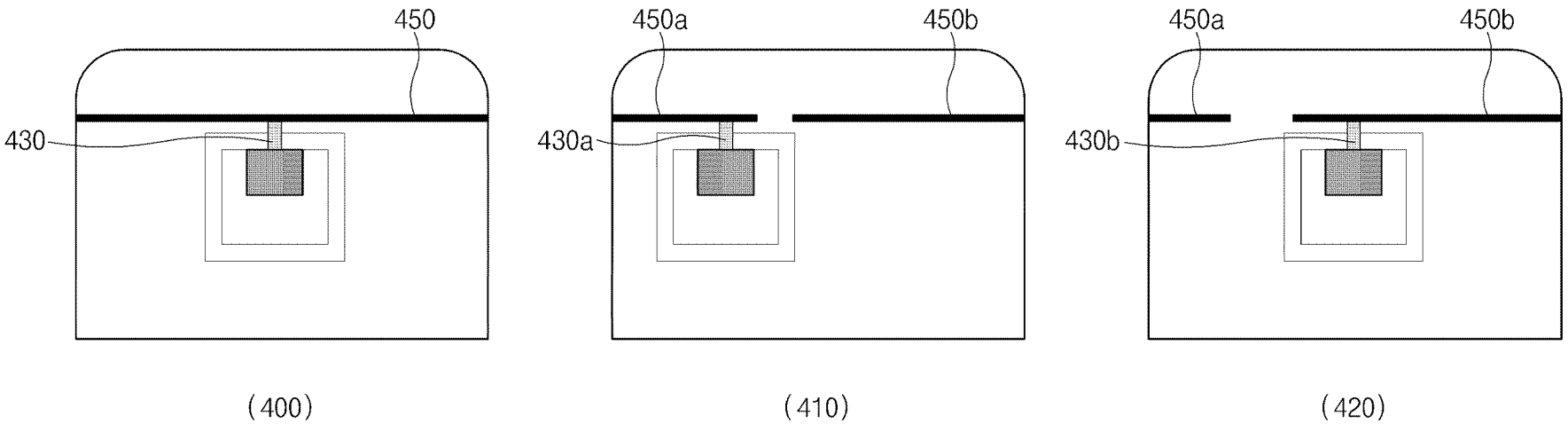
FIG. 4 is a plan view of a plate of an electronic device, according to an embodiment.

FIG. 4 is a plan view of a plate of an electronic device, according to an embodiment.

Referring to FIG. 4, a first area 430 of the electronic device 400 may be formed perpendicularly to a slit 450. A path of a current flowing through the coil antenna may extend to a slit 450 due to the first area 430 being formed perpendicularly to the slit 450, causing a strong magnetic field. Accordingly, the performance of the coil antenna may be improved. For example, an opening connected to the first area 430 may be a camera hole for radiating signals.

In another embodiment, in order to form a radiation path of the coil antenna disposed in the interior of the housing, a longitudinal slit that is perpendicular to the slit 450 and filled with the dielectric material of the slit 450 may be added.

Table 1, below, represents result values obtained by measuring the efficiencies of a case (1) in which a longitudinal slit is applied, and a case (2) in which the first area 430 is formed of aluminum oxide, when the coil antenna is an NFC coil antenna. Referring to Table 1, there is no difference between the efficiencies of the case in which the longitudinal slit is applied and the case in which the aluminum oxide area is formed.

TABLE 1

| Coil to Coil Efficiency of NFC | | |
|---|---|---|
| 1 | Longitudinal slit | 48.2% |
| 1 | Aluminum oxide | 48.2% |

However, because the longitudinal slit has a different external appearance, the design of the electronic device may be improved when the first area 430 of the electronic device 400 is formed of a metal oxide, of which an external appearance is substantially the same as that of the housing.

When the first area 430 is formed in a longitudinal form or a longitudinal slit is added, the efficiency of the antenna in a specific frequency band may decrease, as a parasite resonance may occur.

In an experimental example, when a separate antenna element was included at an upper end of a plate of the electronic device 400, the efficiency of the antenna element decreased as a parasite resonance of a low frequency band of 700 MHz to 800 MHz occurred.

According to an embodiment of the present disclosure, the electronic device of FIGS. 1 to 3 may include a transverse metal oxide area (e.g., the first area 130 of FIG. 1). In this case, the parasite resonance does not occur. Accordingly, the performance of the antenna may be improved through the transverse radiation path.

Figure 5:
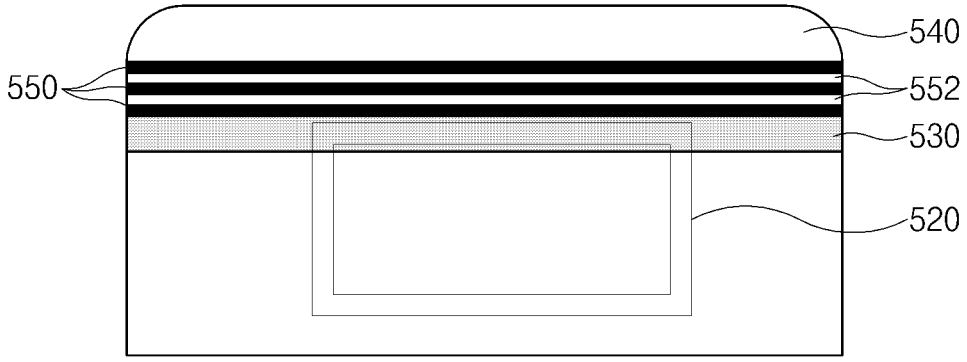
FIG. 5 are plan views of a plate of an electronic device including a plurality of slits, according to an embodiment.
Figure 5:
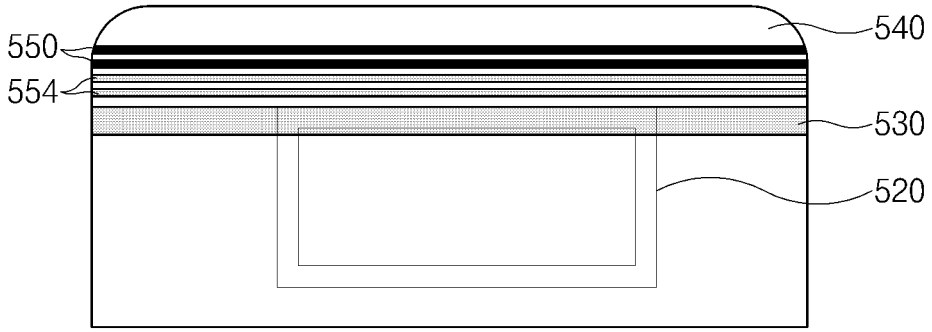
Figure 5:
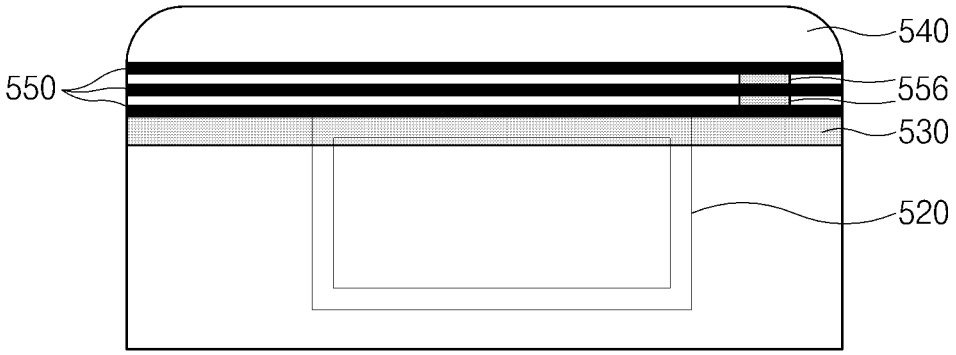

FIG. 5 are plan views of a plate of an electronic device including a plurality of slits, according to an embodiment. The plan views of FIG. 5 correspond to where the first slit 150 of FIG. 1 includes a plurality of thin slits.

Referring to FIG. 5, the electronic device 500 includes a plurality of slits 550. For example, the at least one slit 150 of FIG. 1 may include a plurality of slits 550.

A plurality of metal layers 552 may be formed between the plurality of slits 550. The metal layer 552 may be formed of the same metal as the housing. A multi-slit structure including a plurality of slits 550 and a plurality of layers 552 may be applied to the electronic device to improve the design of the electronic device.

Figure 6A:
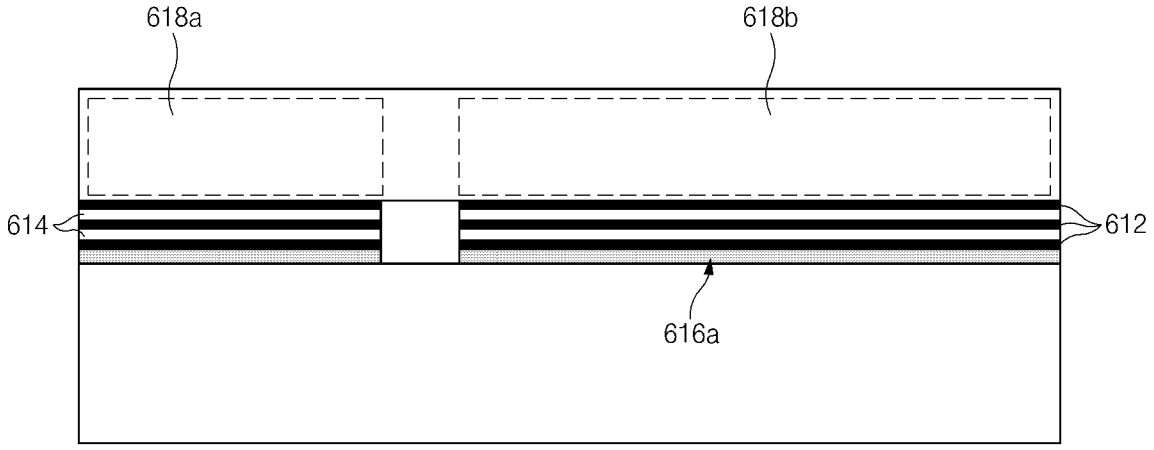
FIGS. 6A, 6B, and 6C illustrate a performance measurement result of an antenna element included in a housing, according to embodiments.
Figure 6A:
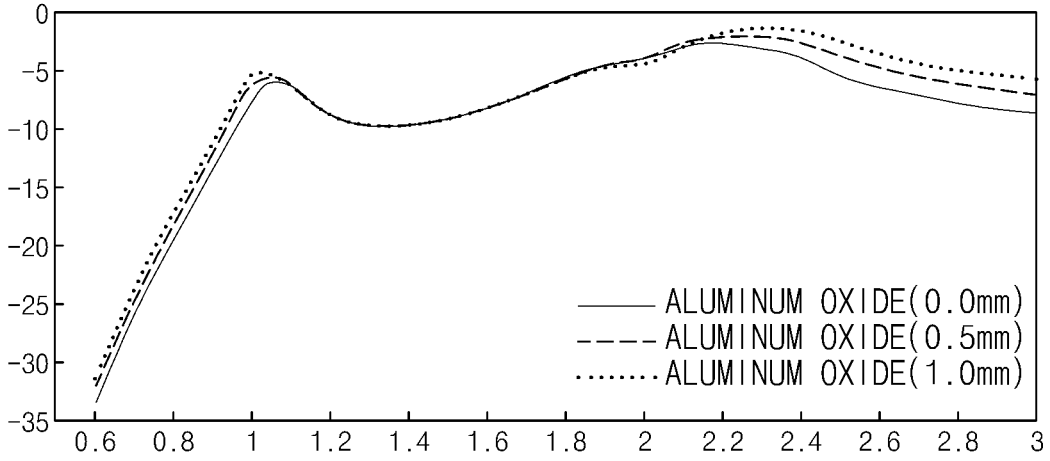
Figure 6B:
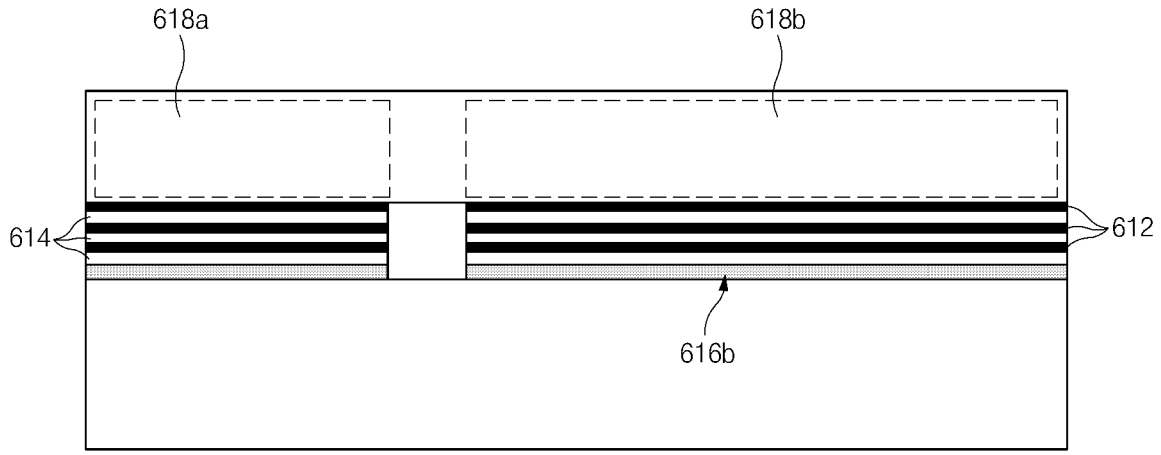
Figure 6B:
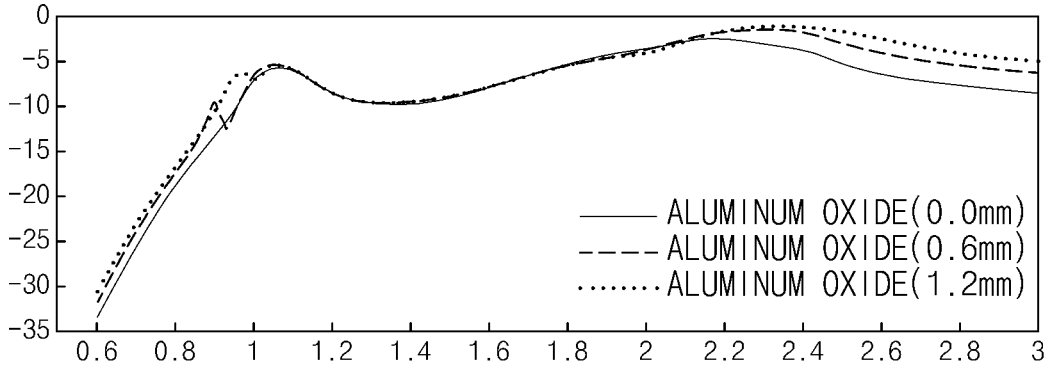
Figure 6C:
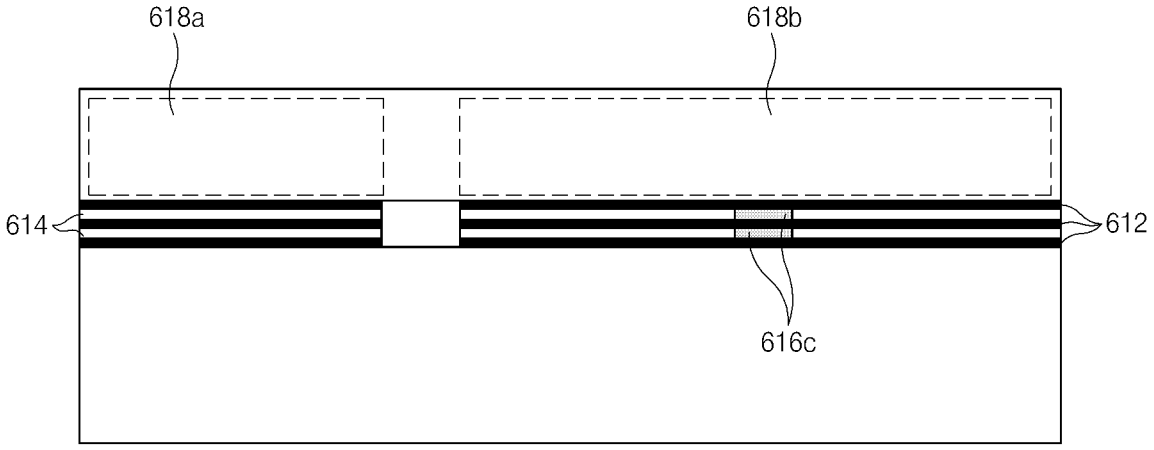
Figure 6C:
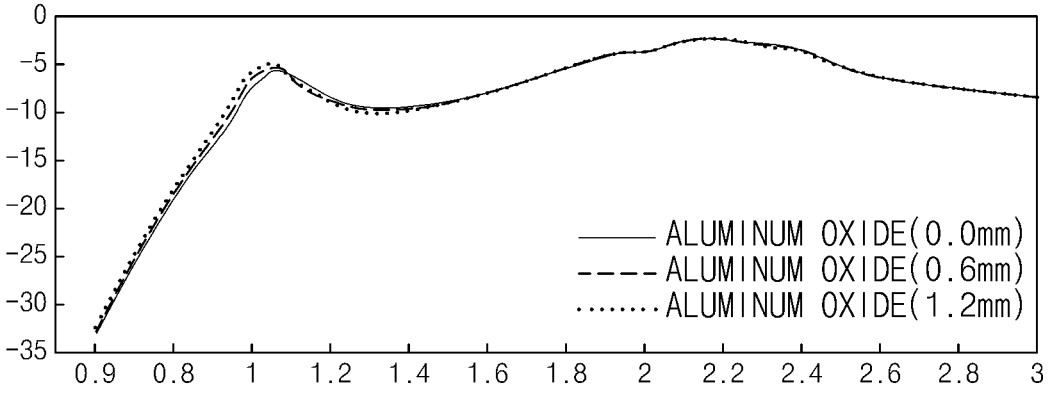

The multi-slit structure may include a slit 150 of FIG. 1 that is filled with an insulating material, the permittivity of which is different from that of the metal oxide constituting the first area 530 and the metal oxide area. The plurality of slits 550 may function to isolate a second area 540 and another portion of the housing. An isolation effect may be improved through the multi-slit structure. As a result, the performance of the antenna included in the housing may be improved. As will be discussed, the related performance measurement data is illustrated in FIGS. 6A to 6C.

If the first area 530 is disposed adjacent to the plurality of slits 550, the isolation effect of the plurality of slits 550 may be further improved. The first area 530 may contact the plurality of slits 550, and may be formed in an area that is spaced apart from the plurality of slits 550 by a specific distance (e.g., the interval between the plurality of slits). The isolation effect may be enhanced as the portions insulated by the first area 530 and the plurality of slits 550 increase, and the radiation performance of the antenna may be further improved.

The electronic device 500*a* may further include at least one additional slit 554 disposed between the first area 530 and the plurality of slits 550. The additional slit 554 may be filled with a metal oxide that forms the first area 530. The widths of the plurality of slits 550 and the second slit 554 of the electronic device 500*a* may be different. The isolation effect may be enhanced as the first area 530 and the plurality of slits 550 provides insulation, and the radiation performance of the antenna may be further improved.

As partial areas 556 of the metal layers 552 between the plurality of slits 550 of the electronic device 500*b* are formed of a metal oxide, the plurality of slits 550 may be partially connected to each other.

For example, the plurality of slits 550 may include a first slit and a second slit that is spaced apart from the first slit. The partial area between the first slit and the second slit may be formed of the conductive material. Another partial area that is different form the partial area between the first slit and the second slit may be formed of the metal oxide.

As the plurality of slits 550 are connected to each other, the width of the plurality of slits 550 may become larger. The isolation effect may be enhanced as the parts insulated by the first area 530 and the plurality of slits 550 increase, and the performance of the antenna may be further improved. Further, the resonance frequency of the antenna element that uses the second area 540 may be changed by changing the electrical length of the metal layer 552.

FIGS. 6A, 6B, and 6C illustrate a performance measurement result of an antenna element included in a housing, according to embodiments.

The plurality of slits included in the housing of the electronic device 100 of FIG. 1 may be combined with the metal oxide area. Because the combination enhances the isolation effect, the performance of the antenna included in the housing may be improved.

In an experimental example, the electronic device includes a housing formed of aluminum, a first antenna element and a second antenna element included in the housing, a plurality of slits, and a nonmetallic area of aluminum oxide. An NFC antenna coil is disposed in the interior of the housing to overlap the nonmetallic area of aluminum oxide. The first antenna element and the second antenna element may be main antennas for communication that are disposed in a housing plate.

The electronic device of the experimental example may be referenced by the slit 350 of the electronic device 300 of FIG. 3 including a plurality of slits. FIGS. 6A to 6C may indicate the conductive material disposed below the rectangular areas of the plurality of slits.

Referring to FIGS. 6A-6C, the electronic devices 610*a*, 620*a*, and 630*a* may include a first antenna element 618*a*, a second antenna element 618*b*, three slits 612 of 0.3 mm and two metal layers 614 of 0.6 mm, and an aluminum oxide area 616*a*, 616*b*, and 616*c*.

The first antenna element 618*a* and the second antenna element 618*b* may be main antennas for cellular communication. The first antenna element 618*a* may transmit and receive a frequency of a high frequency band, and the second antenna element 618*b* may transmit and receive a frequency of a low frequency band.

FIG. 6A illustrates a first experimental example, FIG. 6B illustrates a second experimental example, and FIG. 6C illustrates a third experimental example.

Referring to FIG. 6A, in the first experimental example, when the thickness of an aluminum oxide area 616*a* is substantially close to 0.00 mm, 0.5 mm, and 1.0 mm, the efficiencies of a first antenna element 618*a* and a second antenna element 618*b* were measured for the respective cases.

Referring to the graph 610*b*, the efficiency of the first antenna element 618*a* was improved by about 2.5 dB and the efficiency of the second antenna 618*b* was improved by about 1 dB when the thickness of the aluminum oxide area 616*a* was 1.0 mm, as compared with the case in which the thickness of the aluminum oxide area 616*a* was substantially close to 0.0 mm. Thus, the performance of the antenna improved as the width of the aluminum oxide area 616*a* increased.

Referring to FIG. 6B, in the second experimental example, one slit was added to a plurality of slits of the electronic device 620*a*, and the added slit 616*b* was filled with aluminum oxide. The added slit was an aluminum oxide area 616*b*. As the number of slits increases and the thickness of the added slit increases, the total area of the slits become larger.

Referring to the graph 620*b*, the efficiencies of the first antenna element 618*a* and the second antenna element 618*b* were measured where one aluminum oxide slit 616*b* was added and the thicknesses of the aluminum oxide slit 616*b* were substantially 0.0 mm, 0.6 mm, and 1.2 mm. As the aluminum oxide slit 616*b* became thicker, the bandwidth of the low frequency band improved and the efficiency of the first antenna element 618*a* of a high frequency band improved.

Referring to FIG. 6C, in the third experimental example, a partial area 616*c* of the metal layers 614 between the plurality of slits 612 of the electronic device 630*a* were formed of aluminum oxide. Accordingly, the plurality of slits 612 became partially connected to each other.

Referring to the graph 630*b*, the efficiencies of the first antenna element 618*a* and the second antenna element 618*b* were measured when the extents of the aluminum oxide area 616*c* were 4.0 mm×0.0 mm (substantially close to 0.0 mm), 4.0 mm×0.6 mm, and 4.0 mm×0.2 mm. It can be seen from the graph 630*b* that the efficiency of the second antenna element 618*b* in the low frequency band was improved.

Accordingly, the electronic device of the present disclosure may have an advantage in an aspect of its design because the housing and the plurality of slits have the same external appearance by adding an aluminum oxide area to the aluminum housing, and the efficiency of the antenna may be improved by increasing the radiation performance.

Figure 7:
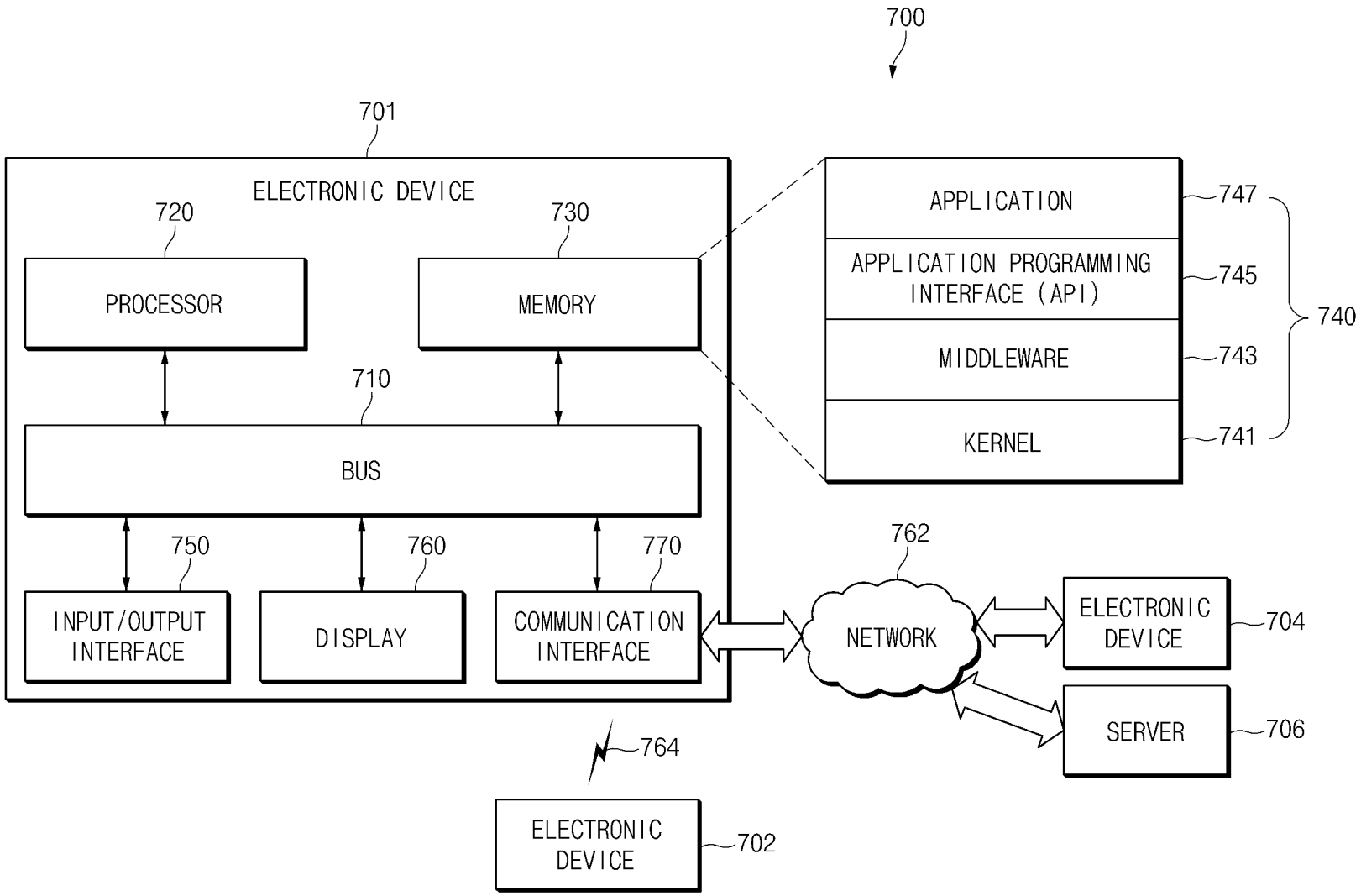
FIG. 7 illustrates an electronic device in a network environment, according to an embodiment.

FIG. 7 illustrates an electronic device in a network environment system, according to an embodiment.

Referring to FIG. 7, an electronic device 701, a first electronic device 702, a second electronic device 704, or a server 706 may be connected each other over a network 762 or a short range communication 764. The electronic device 701 may include a bus 710, a processor 720, a memory 730, an input/output interface 750, a display 760, and a communication interface 770. The electronic device 701 may not include at least one of the above-described elements or may further include other element(s).

The bus 710 may interconnect elements 710 to 770 and may include a circuit for conveying communications (e.g., a control message and/or data) among the above-described elements.

The processor 720 may include one or more of a CPU, an AP, or a communication processor (CP). For example, the processor 720 may perform an arithmetic operation or data processing associated with control and/or communication of at least one other element of the electronic device 701.

The memory 730 may include a volatile and/or nonvolatile memory. The memory 730 may store commands or data associated with at least one other element(s) of the electronic device 701. The memory 730 may store software and/or a program 740. The program 740 may include a kernel 741, a middleware 743, an application programming interface (API) 745, and/or an application program (or "an application") 747. At least a part of the kernel 741, the middleware 743, or the API 745 may be referred to as an operating system (OS).

The kernel 741 may control or manage system resources (e.g., the bus 710, the processor 720, and the memory 730) that are used to execute operations or functions of other programs (e.g., the middleware 743, the API 745, and the application program 747). Furthermore, the kernel 741 may provide an interface that allows the middleware 743, the API 745, or the application program 747 to access discrete elements of the electronic device 701 so as to control or manage system resources.

The middleware 743 may perform a mediation role such that the API 745 or the application program 747 communicates with the kernel 741 to exchange data.

The middleware 743 may process task requests received from the application program 747 according to a priority. The middleware 743 may assign the priority, making it possible to use system resources (e.g., the bus 710, the processor 720, or the memory 730) of the electronic device 701, to at least one application program 747. The middleware 743 may process one or more task requests according to the priority assigned, making it possible to perform scheduling or load balancing on the one or more task requests.

The API 745 may be an interface through which the application program 747 controls a function provided by the kernel 741 or the middleware 743, and may include at least one interface or function (e.g., an instruction) for file control, window control, image processing, or character control.

The input/output interface 750 may transmit a command or data input from a user or another external device, to other element(s) of the electronic device 701. Furthermore, the input/output interface 750 may output a command or data, received from other element(s) of the electronic device 701, to a user or another external device.

The display 760 may include a liquid crystal display (LCD), a light-emitting diode (LED) display, an OLED display, a microelectromechanical systems (MEMS) display, or an electronic paper display. The display 760 may display various contents (e.g., text, images, videos, icons, and symbols) to a user. The display 760 may include a touch screen and may receive a touch, a gesture, a proximity, or a hovering type of input using an electronic pen or a part of a user's body.

The communication interface 770 may establish communication between the electronic device 701 and the first electronic device 702, the second electronic device 704, or the server 706. The communication interface 770 may be connected to the network 762 over wireless communication or wired communication to communicate with the second electronic device 704 or the server 706.

The wireless communication may use at least one of long term evolution (LTE), LTE Advanced (LTE-A), code division multiple access (CDMA), wideband CDMA (WCDMA), universal mobile telecommunications system (UMTS), wireless broadband (WiBro), or global system for mobile communications (GSM), as a cellular communication protocol. Furthermore, the wireless communication may include the short range communication 764. The short range communication 764 may include at least one of Wi-Fi, BT, NFC, MST, or a GNSS.

The MST may generate a pulse in response to transmission data using an electromagnetic signal, and the pulse may generate a magnetic field signal. The electronic device 701 may transfer the magnetic field signal to a point of sale (POS), and the POS may detect the magnetic field signal using an MST reader. The POS may recover the data by converting the detected magnetic field signal to an electrical signal.

The GNSS may include at least one of a GPS, a global navigation satellite system (Glonass), a Beidou navigation satellite system (hereinafter referred to as "Beidou"), or an European global satellite-based navigation system (hereinafter referred to as "Galileo") based on an available region or a bandwidth. Hereinafter, "GPS" and "GNSS" may be interchangeably used. The wired communication may include at least one of a universal serial bus (USB), a high definition multimedia interface (HDMI), a recommended standard-232 (RS-232), or a plain old telephone service (POTS). The network 762 may include at least one of telecommunications networks, such as a computer network (e.g., a local area network (LAN) or a wide area network (WAN)), the Internet, or a telephone network.

Each of the first and second electronic devices 702 and 704 may be a device of which the type is different from or the same as that of the electronic device 701. The server 706 may include a group of one or more servers. All or some of the operations that the electronic device 701 will perform may be executed by the first electronic device 702, the second electronic device 704 the server 706, or another electronic device. In the case where the electronic device 701 executes any function or service automatically or in response to a request, the electronic device 701 may not perform the function or the service internally, but, alternatively or additionally, it may request at least a portion of a function associated with the electronic device 701 from another device (e.g., the electronic device 702, the electronic device 704 or the server 706). The other electronic device may execute the requested function or additional function and may transmit the execution result to the electronic device 701. The electronic device 701 may provide the requested function or service using the received result or may additionally process the received result to provide the requested function or service. To this end, for example, cloud computing, distributed computing, or client-server computing may be used.

Figure 8:
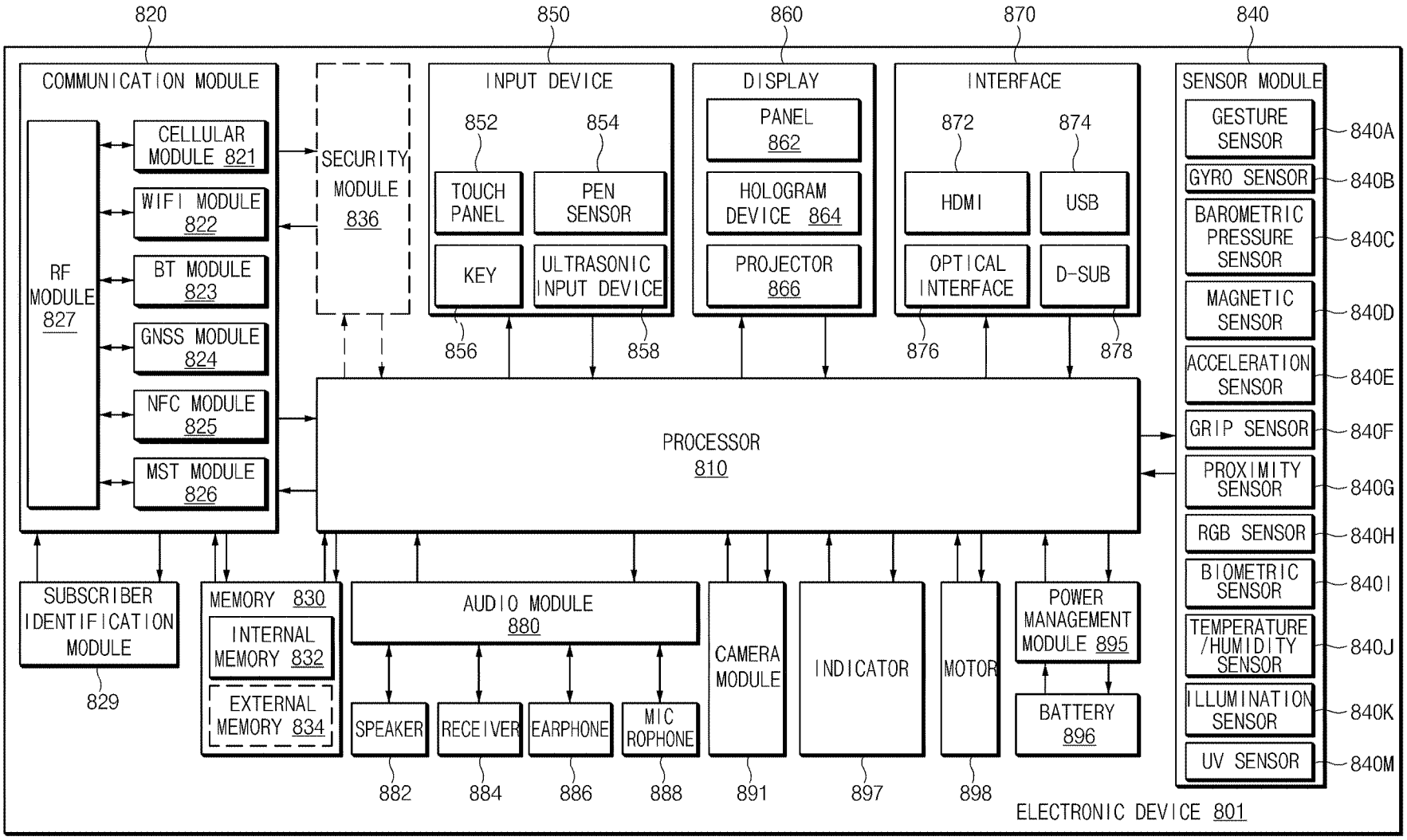
FIG. 8 is a block diagram of an electronic device, according to an embodiment.

FIG. 8 illustrates a block diagram of an electronic device, according to an embodiment.

Referring to FIG. 8, an electronic device 801 may include all or a part of the electronic device 100 illustrated in FIG. 1 or the electronic device 701 illustrated in FIG. 7. The electronic device 801 may include one or more processors (e.g., an AP) 810, a communication module 820, a subscriber identification module (SIM) 829, a memory 830, a sensor module 840, an input device 850, a display 860, an interface 870, an audio module 880, a camera module 891, a power management module 895, a battery 896, an indicator 897, and a motor 898.

The processor 810 may drive an OS or an application to control a plurality of hardware or software elements connected to the processor 810 and may process and compute a variety of data. The processor 810 may be implemented with a System on Chip (SoC). The processor 810 may further include a graphic processing unit (GPU) and/or an image signal processor. The processor 810 may include at least some (e.g., a cellular module 821) of the elements illustrated in FIG. 8. The processor 810 may load a command or data, which is received from at least one other element (e.g., a nonvolatile memory), into a volatile memory and process the loaded command or data. The processor 810 may store a variety of data in the nonvolatile memory.

The communication module 820 may be configured the same as or similar to the communication interface 770 of FIG. 7. The communication module 820 may include the cellular module 821, a Wi-Fi module 822, a BT module 823, a GNSS module 824 (e.g., a GPS module, a Glonass module, a Beidou module, or a Galileo module), an NFC module 825, an MST module 826 and an RF module 827.

The cellular module 821 may provide voice communication, video communication, a character service, or an Internet service over a communication network. The cellular module 821 may perform discrimination and authentication of the electronic device 801 within a communication network by using the SIM (e.g., a SIM card) 829. The cellular module 821 may perform at least a portion of functions that the processor 810 provides. The cellular module 821 may include a CP.

Each of the Wi-Fi module 822, the BT module 823, the GNSS module 824, the NFC module 825, and the MST module 826 may include a processor for processing data exchanged through a corresponding module. At least a part (e.g., two or more) of the cellular module 821, the Wi-Fi module 822, the BT module 823, the GNSS module 824, the NFC module 825, or the MST module 826 may be included within one integrated circuit (IC) or an IC package.

The RF module 827 may transmit and receive a communication signal (e.g., an RF signal) and may include a transceiver, a power amplifier module (PAM), a frequency filter, a low noise amplifier (LNA), or an antenna. At least one of the cellular module 821, the Wi-Fi module 822, the BT module 823, the GNSS module 824, the NFC module 825, or the MST module 826 may transmit and receive an RF signal through a separate RF module.

The SIM 829 may include a card and/or an embedded SIM that includes a SIM and unique identify information (e.g., an integrated circuit card identifier (ICCID)) or subscriber information (e.g., an integrated mobile subscriber identity (IMSI)).

The memory 830 may include an internal memory 832 or an external memory 834. The internal memory 832 may include at least one of a volatile memory (e.g., a dynamic random access memory (DRAM), a static RAM (SRAM), or a synchronous DRAM (SDRAM)), a nonvolatile memory (e.g., a one-time programmable read only memory (OTPROM), a programmable ROM (PROM), an erasable and programmable ROM (EPROM), an electrically erasable and programmable ROM (EEPROM), a mask ROM, a flash ROM, or a flash memory (e.g., a NAND flash memory or a NOR flash memory)), a hard drive, or a solid state drive (SSD).

The external memory 834 may further include a flash drive such as compact flash (CF), secure digital (SD), micro secure digital (Micro-SD), mini secure digital (Mini-SD), extreme digital (xD), a multimedia card (MMC), or a memory stick. The external memory 834 may be operatively and/or physically connected to the electronic device 801 through various interfaces.

A security module 836 may be a module that includes a storage space of which a security level is higher than that of the memory 830 and may be a circuit that guarantees safe data storage and a protected execution environment. The security module 836 may be implemented with a separate circuit and may include a separate processor. For example, the security module 836 may be in a smart chip or a secure digital (SD) card, which is removable, or may include an embedded secure element (eSE) embedded in a fixed chip of the electronic device 801. Furthermore, the security module 836 may operate based on an OS that is different from the OS of the electronic device 801. For example, the security module 836 may operate based on java card open platform (JCOP) OS.

The sensor module 840 may measure a physical quantity or may detect an operation state of the electronic device 801. The sensor module 840 may convert the measured or detected information to an electric signal. The sensor module 840 may include at least one of a gesture sensor 840A, a gyro sensor 840B, a barometric pressure sensor 840C, a magnetic sensor 840D, an acceleration sensor 840E, a grip sensor 840F, the proximity sensor 840G, a color sensor 840H (e.g., red, green, blue (RGB) sensor), a biometric sensor 840I, a temperature/humidity sensor 840J, an illuminance sensor 840K, or a UV sensor 840M. Additionally or alternatively, the sensor module 840 may further include an E-nose sensor, an electromyography (EMG) sensor, an electroencephalogram (EEG) sensor, an electrocardiogram (ECG) sensor, an infrared (IR) sensor, an iris sensor, and/or a fingerprint sensor. The sensor module 840 may further include a control circuit for controlling at least one or more sensors included therein. The electronic device 801 may further include a processor that is a part of the processor 810 or independent of the processor 810 and is configured to control the sensor module 840. The processor may control the sensor module 840 while the processor 810 remains at a sleep state.

The input device 850 may include a touch panel 852, a (digital) pen sensor 854, a key 856, or an ultrasonic input unit 858. The touch panel 852 may use at least one of capacitive, resistive, infrared and ultrasonic detecting methods. Also, the touch panel 852 may further include a control circuit. The touch panel 852 may further include a tactile layer to provide a tactile reaction to a user.

The (digital) pen sensor 854 may be a part of a touch panel or may include an additional sheet for recognition. The key 856 may include a physical button, an optical key, or a keypad. The ultrasonic input device 858 may detect (or sense) an ultrasonic signal, which is generated from an input device, through a microphone 888 and may check data corresponding to the detected ultrasonic signal.

The display 860 may include a panel 862, a hologram device 864, or a projector 866. The panel 862 may be the same as or similar to the display 760 illustrated in FIG. 7. The panel 862 may be implemented to be flexible, transparent or wearable. The panel 862 and the touch panel 852 may be integrated into a single module. The hologram device 864 may display a stereoscopic image in a space using a light interference phenomenon. The projector 866 may project light onto a screen so as to display an image. The screen may be arranged in the inside or the outside of the electronic device 801. The display 860 may further include a control circuit for controlling the panel 862, the hologram device 864, or the projector 866.

The interface 870 may include a high-definition multimedia interface (HDMI) 872, a universal serial bus (USB) 874, an optical interface 876, or a D-subminiature (D-sub) 878. The interface 870 may be included in the communication interface 770 illustrated in FIG. 7. Additionally or alternatively, the interface 870 may include a mobile high definition link (MHL) interface, an SD card/MMC interface, or an Infrared Data Association (IrDA) standard interface.

The audio module 880 may convert a sound and an electric signal in dual directions. At least a part of the audio module 880 may be included in the input/output interface 750 illustrated in FIG. 7. The audio module 880 may process sound information that is input or output through a speaker 882, a receiver 884, an earphone 886, or the microphone 888.

The camera module 891 may shoot a still image or a video. The camera module 891 may include at least one or more image sensors (e.g., a front sensor or a rear sensor), a lens, an image signal processor (ISP), or a flash (e.g., an LED or a xenon lamp).

The power management module 895 may manage power of the electronic device 801. A power management integrated circuit (PMIC), a charger IC, or a battery or fuel gauge may be included in the power management module 895. The PMIC may have a wired charging method and/or a wireless charging method. The wireless charging method may include a magnetic resonance method, a magnetic induction method or an electromagnetic method and may further include an additional circuit, such as a coil loop, a resonant circuit, or a rectifier. The battery gauge may measure a remaining capacity of the battery 896 and a voltage, or a current or temperature thereof. The battery 896 may include a rechargeable battery and/or a solar battery.

The indicator 897 may display a specific state of the electronic device 801 or a part thereof (e.g., the processor 810), such as a booting state, a message state, and a charging state. The motor 898 may convert an electrical signal into a mechanical vibration and may generate a vibration or a haptic effect. A processing device (e.g., a GPU) for supporting a mobile TV may be included in the electronic device 801. The processing device for supporting the mobile TV may process media data according to the standards of digital multimedia broadcasting (DMB), digital video broadcasting (DVB), or MediaFlo™.

Each of the above-mentioned elements of the electronic device may be configured with one or more components, and the names of the elements may be changed according to the type of the electronic device. In various embodiments, the electronic device may include at least one of the above-mentioned elements, and some elements may be omitted or other additional elements may be added. Furthermore, some of the elements of the electronic device may be combined with each other so as to form one entity, so that the functions of the elements may be performed in the same manner as before the combination.

Referring to FIG. 1, according to an embodiment, the electronic device 100 includes a first antenna 120 configured to transmit and receive a first signal of a first frequency band, and a housing in which the first antenna 120 is accommodated, the housing includes a first conductor 165 having a first slit 130 that at least partially overlaps the first antenna, wherein the first conductor is formed of a metal and at least a portion of the first slit is filled with a metal oxide, a second conductor 160 configured to transmit and receive a second signal of a second frequency band, and a second slit 150 formed between the first conductor and the second conductor, and the second slit is filled with a material that has an external appearance that is different from that of the second conductor.

A signal output from the first antenna 120 may be transmitted to the outside through at least a portion of the first slit.

The first antenna 120 may include an NFC antenna.

The first conductor 165 and the second conductor 160 may be isolated by the first slit 130.

According to another embodiment, an electronic device 100 includes a housing that defines an external appearance of the electronic device, a coil antenna 120 accommodated in the interior of the housing, and a wireless communication circuit configured to feed electric power to the coil antenna 120, and the housing includes a first area 130 that at least partially overlaps an area in which the coil antenna 120 is disposed and that is formed of a metal oxide, a second area 140 spaced apart from the first area and formed of a conductive material, and at least one slit 150 disposed between the first area 130 and the second area 140.

The housing may be formed of aluminum and the metal oxide may be aluminum oxide.

The slit may extend from any one point of a first side 112 of a periphery of the housing to any one point of a second side 114 of the periphery of the housing, which faces the first side 112.

The first area 130 may extend from any one point of the first side 112 to any one point of the second side 114, in parallel to the slit.

The first area 130 may be formed perpendicularly to the slit.

Referring, to FIG. 5, the slit may include a plurality of slits 550 formed in parallel to each other.

The slit may further include at least one additional slit 524 disposed between the first area and the plurality of slits 550, and the additional slit is filled with the metal oxide.

The plurality of slits 550 may include a first slit and a second slit 554 spaced apart from the first slit, a partial area between the first slit and the second slit 554 may be formed of the conductive material, and an additional partial area that is different form the partial area between the first slit and the second slit 554 may be formed of the metal oxide.

Referring to FIG. 3, an electronic device 300, according to another embodiment, includes a housing including a first plate 310 having a first width, a second plate that is opposite to the first plate, and a side surface that surrounds a space between the first plate and the second plate, a coil antenna 320 accommodated in the interior of the housing, and a wireless communication circuit configured to feed electric power to the coil antenna 320, the first plate 310 includes a first conductive area 340 having the first width and formed of a conductive material, a slit 350 having the first width and formed adjacent to the first conductive area, a first area 330 having the first width, being adjacent to the slit, and formed of a metal oxide, and a second conductive area 360 having the first width, being adjacent to the first area 330, and formed of the conductive material that partially overlaps the coil antenna 320, and the first area 330 overlaps the coil antenna 320 in at least a partial area, and the conductive material is disposed below the slit 350 and the at least a portion of the first area 330.

The wireless communication circuit may feed electric power to the first conductive area 340, the coil antenna 320 may transmit and receive a first signal of a first frequency band, and the first conductive area 340 may include a second area **340*a* configured to transmit and receive a second signal of a second frequency band that is different from the first frequency band, and a third area 340*b*** configured to transmit and receive a third signal of a third frequency band that is different from the first frequency band and the second frequency band.

The second frequency band may be higher than the third frequency band.

The first conductive area 340 and the second conductive area **340*a* may be electrically connected to each other by the conductive material 335 disposed below a portion of the first area 340**.

A signal output from the coil antenna 320 may be transmitted to the outside through an area of the first area 330, except for the portion at which the conductive material is disposed.

The first conductive area 340 and the second conductive area 340*a* may be isolated by an area of the first area 330, except for the portion at which the conductive material 335 is disposed.

The side surface may include a first side 312, a second side 314 that faces the first side 312, and a third side 316 that is perpendicular to the first side 312, and the first area 330 and the slit extend from a first point of the first side 312 to a second point of the second side 314 in parallel to the third side 316.

The slit may be filled with an insulating material having a first permittivity and the first area 330 may be formed of a metal oxide having a second permittivity that is higher than the first permittivity.

The term "module" may represent, for example, a unit including one or more combinations of hardware, software and firmware. The term "module" may be interchangeably used with the terms "unit", "logic", "logical block", "component" and "circuit". The "module" may be a minimum unit of an integrated component or may be a part thereof. The "module" may be a minimum unit for performing one or more functions or a part thereof. The "module" may be implemented mechanically or electronically. The "module" may include at least one of an application specific IC (ASIC) chip, a field programmable gate array (FPGA), and a programmable-logic device for performing some operations, which are known or will be developed.

At least a part of an apparatus (e.g., modules or functions thereof) or a method (e.g., operations) may be implemented by instructions stored in a computer-readable storage media in the form of a program module. The instruction, when executed by a processor 720, may cause the one or more processors to perform a function corresponding to the instruction. The computer-readable storage media may be the memory 730.

A computer-readable recording medium may include a hard disk, a floppy disk, a magnetic media (e.g., a magnetic tape), an optical media (e.g., a compact disc read only memory (CD-ROM) and a DVD, a magneto-optical media (e.g., a floptical disk)), and hardware devices (e.g., a ROM, a RAM, or a flash memory). Also, the one or more instructions may contain a code made by a compiler or a code executable by an interpreter. The above hardware unit may be configured to operate via one or more software modules for performing an operation, and vice versa.

A module or a program module may include at least one of the above elements, or a part of the above elements may be omitted, or additional other elements may be further included. Operations performed by a module, a program module, or other elements may be executed sequentially, in parallel, repeatedly, or in a heuristic method. In addition, some operations may be executed in different sequences or may be omitted. Alternatively, other operations may be added.

While the present disclosure has been shown and described with reference to certain embodiments, it will be understood by those skilled in the art that various changes in form and details may be made therein without departing from the spirit and scope of the present disclosure, which is defined, not by the detailed description and embodiments, but by the appended claims and their equivalents.

What is claimed is:

1. An electronic device, comprising:

a housing that defines an external appearance of the electronic device;

a coil antenna accommodated in the interior of the housing; and a wireless communication circuit configured to feed electric power to the coil antenna, wherein the housing includes:

a first area that at least partially overlaps an area in which the coil antenna is disposed and that is formed of a metal oxide;

a second area spaced apart from the first area and formed of a conductive material; and at least one slit disposed between the first area and the second area, and wherein the slit includes a first slit and a second slit formed in parallel to each other and wherein the second slit is filled with an insulating material having a first permittivity, and a metal oxide that fills the first slit has a second permittivity that is higher than the first permittivity.

2. The electronic device of claim 1, wherein the housing is formed of aluminum and the metal oxide includes aluminum oxide.

3. The electronic device of claim 1, wherein the slit extends from any one point of a first side of a periphery of the housing to any one point of a second side of the periphery of the housing, which faces the first side.

4. The electronic device of claim 3, wherein the first area extends from any one point of the first side to any one point of the second side, in parallel to the slit.

5. The electronic device of claim 3, wherein the first area is formed perpendicularly to the slit.

6. The electronic device of claim 1, wherein a partial area between the first slit and the second slit is formed of the conductive material, and wherein an additional partial area that is different form the partial area between the first slit and the second slit is formed of the metal oxide.

7. An electronic device, comprising:

a housing including a first plate having a first width, a second plate that is opposite to the first plate, and a side surface that surrounds a space between the first plate and the second plate;

a coil antenna accommodated in the interior of the housing; and a wireless communication circuit configured to feed electric power to the coil antenna, wherein the first plate includes:

a first conductive area having the first width and formed of a conductive material;

a slit having the first width and formed adjacent to the first conductive area;

a first area having the first width, being adjacent to the slit, and formed of a metal oxide; and a second conductive area having the first width, being adjacent to the first area, and formed of the conductive material that partially overlaps the coil antenna, wherein the first area overlaps the coil antenna in at least a partial area, and the conductive material is disposed below the slit and the at least partial area of the first area, wherein the conductive material is disposed below the at least partial area of the first area, and the first conductive area and the second conductive area are electrically connected by the conductive material, and wherein the second conductive area and a third area operate as different antenna elements by the conductive material disposed in the area the at least partial area of the first area.

8. The electronic device of claim 7, wherein the wireless communication circuit feeds electric power to the first conductive area, wherein the coil antenna transmits and receives a first signal of a first frequency band, and wherein the first conductive area includes:

a second area configured to transmit and receive a second signal of a second frequency band that is different from the first frequency band; and the third area configured to transmit and receive a third signal of a third frequency band that is different from the first frequency band and the second frequency band.

9. The electronic device of claim 8, wherein the second frequency band is higher than the third frequency band.

10. The electronic device of claim 7, wherein a signal output from the coil antenna is transmitted to the outside through an area of the first area, except for the portion at which the conductive material is disposed.

11. The electronic device of claim 7, wherein the first conductive area and the second conductive area are isolated by an area of the first area, except for the portion at which the conductive material is disposed.

12. The electronic device of claim 7, wherein the side surface includes:

a first side;

a second side that faces the first side; and a third side that is perpendicular to the first side, and wherein the first area and the slit extend from a first point of the first side to a second point of the second side in parallel to the third side.

13. The electronic device of claim 7, wherein the slit is filled with an insulating material having a first permittivity and the first area is formed of a metal oxide having a second permittivity that is higher than the first permittivity.

* * * * *